US005586964A

United States Patent [19]

Chase

[11] Patent Number: 5,586,964

[45] Date of Patent: Dec. 24, 1996

[54] SYSTEM FOR DELIVERING FOLDED PAPER

[75] Inventor: Walter W. Chase, Glendale, Ariz.

[73] Assignee: B. Bunch Company, Inc., Phoenix, Ariz.

[21] Appl. No.: 333,215

[22] Filed: Nov. 2, 1994

[51] Int. Cl.[6] ..... B31B 3/02; B65H 20/00

[52] U.S. Cl. ..... 493/413; 493/478; 493/412; 270/39.04; 198/406

[58] Field of Search ..... 493/334, 199, 493/405, 409, 410–415, 477–479; 270/39, 40; 414/331, 398, 757; 271/186, 200; 198/406, 403

[56] References Cited

U.S. PATENT DOCUMENTS

| | | | |
|---|---|---|---|
| 2,344,022 | 3/1944 | Brawn | 270/39 |
| 2,506,004 | 5/1950 | Ward | 270/39 |
| 3,466,984 | 9/1969 | Hanson | 270/39 |
| 4,332,581 | 6/1982 | Thompson | 493/410 |
| 4,408,755 | 10/1983 | Meier | 270/39 |
| 4,673,382 | 6/1987 | Buck | 270/39 |
| 4,700,939 | 10/1987 | Hathaway | 270/39 |
| 4,708,332 | 11/1987 | Besemann | 270/39 |
| 4,750,724 | 6/1988 | Herd | 270/39 |
| 4,984,772 | 1/1991 | Freund | 270/39 |
| 5,076,555 | 12/1991 | Bunch | 493/415 |
| 5,080,644 | 1/1992 | Bunch | 4936/414 |
| 5,110,101 | 5/1992 | Roth | 270/39 |
| 5,295,679 | 3/1994 | Reist | 271/186 |
| 5,447,262 | 9/1995 | Frocke | 270/39 |

FOREIGN PATENT DOCUMENTS

| | | | |
|---|---|---|---|
| 1102688 | 3/1961 | Germany | 493/411 |
| 004003451A | 8/1991 | Germany | 493/413 |

*Primary Examiner*—Jack W. Lavinder
*Assistant Examiner*—Christopher W. Day
*Attorney, Agent, or Firm*—Tod R. Nissle, P.C.

[57] ABSTRACT

Apparatus for producing continuous form stationery folds a strip of paper along transverse lines of weakening formed therealong to form a zig-zag stack of paper. The apparatus alters the orientation of the zig-zag stack of paper to facilitate further processing of the paper.

3 Claims, 4 Drawing Sheets

SYSTEM FOR DELIVERING FOLDED PAPER

This invention relates to apparatus for processing a strip of paper.

More particularly, the invention relates to apparatus for producing continuous form stationery by folding a strip of paper along transverse lines of weakening formed therealong to form a zig-zag stack of paper.

In a further respect, the invention relates to apparatus of the type described which alters the orientation of the zig-zag stack of paper to facilitate further processing of the paper.

Spiral paper folding machines, belt folders, refolders and other types of apparatus which produce continuous form stationery by folding a strip or web of paper or other material along transverse lines of weakening formed therealong are well known in the art. See, for example, U.S. Pat. No. 3,912,252 to Stephens, issued Oct. 14, 1975. Such prior art paper folding machines produce a stack of paper folded in zig-zag fashion. This stack of folded paper includes a first group of coplanar parallel folded edges and a second group of coplanar parallel folded edges. The first group of folded edges is spaced apart from and generally parallel to the second group of folded edges. In order to facilitate further handling or processing of the stack of folded paper, it is often desired to re-stack or alter the orientation of the stack of folded paper produced by a paper folding machine. One method of altering the orientation of the stack of folded paper is to simply manually pick up the stack and turn it on a side. Another less labor intensive method is to direct the stack of paper produced by a paper folding onto a horizontal conveyor and from the conveyor into a rectangular L-shaped stainless steel metal chute having an upward ninety-degree elbow or bend. The paper stack travels through the lower horizontal arm of the L-shaped metal chute, through the bend, and upwardly into the vertical arm of the chute. The metal chute cannot turn downwardly because folded paper would free-fall uncontrollably downwardly through the chute. A disadvantage of utilizing the metal chute is that the amount of paper which can be forced upwardly into the vertical arm is limited because the weight of the paper will eventually back up the paper on the conveyor and jam the paper folding mechanism.

Accordingly, it would be highly desirable to provide improved paper processing apparatus which would enable the orientation of a folded stack of paper to be altered without requiring that the stack be manually handled and without limiting the quantity of folded paper which can be stacked by the paper processing apparatus.

These and other, further and more specific objects and advantages of the invention will be apparent to those skilled in the art from the following detailed description thereof, taken in conjunction with the drawings, in which.

Figure 1:
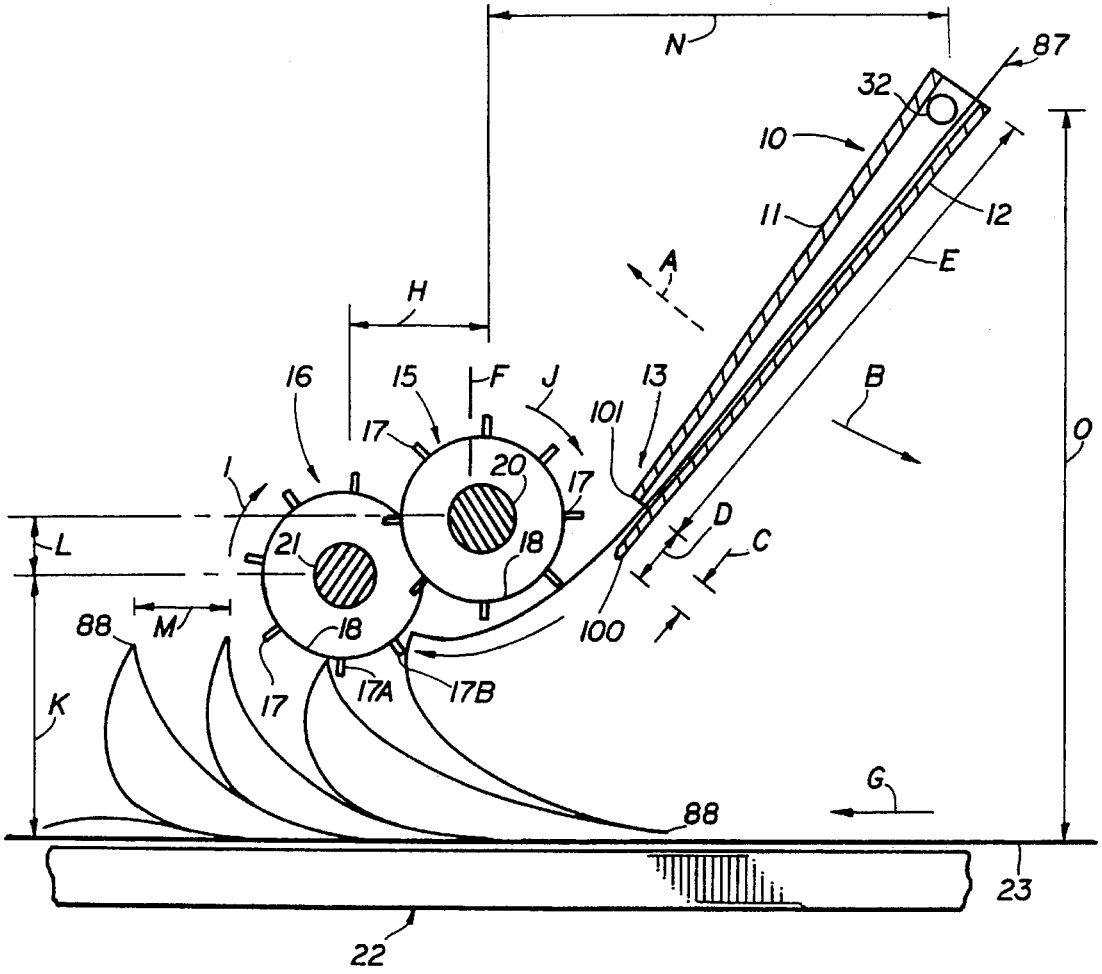
FIG. 1 is a side, partial section view illustrating conventional paper folding apparatus.

Briefly, in accordance with my invention, I provide improved apparatus for producing continuous form stationery by folding a strip of paper along transverse lines of weakening formed therein. The apparatus includes a frame; a guide assembly mounted on the frame for alternately distributing said successive lines of weakening in the paper in substantially opposite directions; a folding assembly carried on the frame and operatively associated with the guide assembly for urging the paper distributed by the guide assembly into a zig-zag folded condition; and, a generally horizontally oriented conveyor assembly for receiving folded paper from the folding assembly, forming a stack of the folded paper, and carrying the stack of folded paper away from the folding assembly in a first direction of travel. The stack of folded paper includes first and second groups of folded edges. The second group of folded edges is generally spaced apart and above the first group of folded edges. The improvement comprises an inverting assembly for turning over the stack of folded paper. The inverting assembly comprises a conveyor for receiving the stack of folded paper from the conveyor assembly and incrementally bending the stack downwardly around to move in a direction rearwardly from the first direction of travel such that the first group of folded edges are spaced above the second group of folded edges.

In an alternate embodiment of my invention, I provide an improved apparatus for producing continuous form stationery by folding a strip of paper along transverse lines of weakening formed therein. The apparatus includes a frame; a guide assembly mounted on the frame for alternately distributing said successive lines of weakening in the paper in substantially opposite directions; a folding assembly carried on the frame and operatively associated with the guide assembly for urging the paper distributed by the guide assembly into a zig-zag folded condition; and, a generally horizontally oriented conveyor assembly for receiving folded paper from the folding assembly, forming a stack of the folded paper, and carrying the stack of folded paper away from the folding assembly in a first direction of travel. The stack of folded paper includes first and second groups of folded edges. The second group of folded edges is generally spaced apart and above the first group of folded edges. The improvement comprises an inverting assembly for turning over the stack of folded paper. The inverting assembly comprises an assembly for compacting the stack of folded paper to form a compressed stack of folded paper; and, a conveyor for receiving the compressed stack of folded paper from the conveyor assembly and incrementally bending the stack downwardly around to move in a direction rearwardly from the first direction of travel such that the first group of folded edges are spaced above the second group of folded edges.

In still another embodiment of my invention, I provide an improved apparatus for producing continuous form stationery by folding a strip of paper along transverse lines of weakening formed therein. The apparatus includes a frame; a guide assembly mounted on the frame for alternately distributing said successive lines of weakening in the paper in substantially opposite directions; a folding assembly carried on the frame and operatively associated with the guide assembly for urging the paper distributed by the guide assembly into a zig-zag folded condition; and, a generally horizontally oriented conveyor assembly for receiving folded paper from the folding assembly, forming a stack of the folded paper, and carrying the stack of folded paper away from the folding assembly in a first direction of travel. The stack of folded paper includes first and second groups of folded edges. The second group of folded edges is generally spaced apart and above the first group of folded edges. The improvement comprises an inverting assembly for turning over the stack of folded paper. The inverting assembly comprises a conveyor for receiving the stack of folded paper from the conveyor assembly and incrementally altering the direction of travel of the stack; and, an assembly for riffling the second group of folded edges to facilitate the altering of the direction of travel of the stack.

Figure 2:
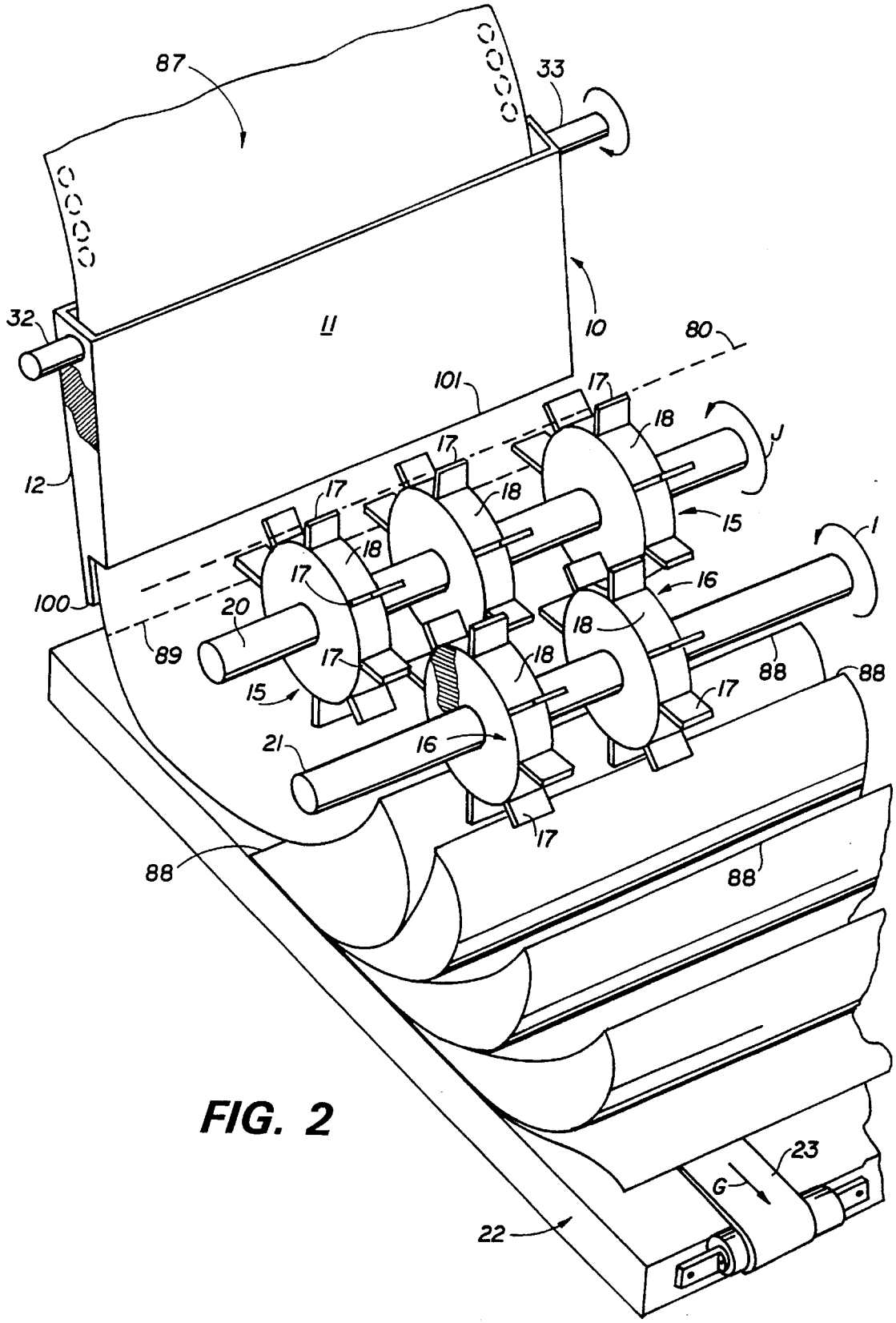
FIG. 2 is a perspective view further illustrating the paper folding apparatus of FIG. 1 and the zig-zag stack of paper formed by the folding apparatus and transported away by a conveyor table.

Turning, now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate a prior art paper folding machine including an oscillating guide means or chute 10. In FIG. 1, chute 10 is illustrated in the farthest extent of its travel in the direction of arrow A and is ready to begin its swing through an arc in the opposite direction indicated by arrow B. Paper strip 87 has transverse lines of weakening or perforation 89 formed therein. Each line of weakening is normally perpendicular to the longitudinal axis of, to the direction of travel of, and to the sides of the strip of paper 87 and is spaced apart from adjacent lines of weakening. Strip 87, which was previously folded along the lines of weakening and was then unfolded for processing, is directed into the apparatus of FIG. 1 to be refolded. In FIG. 1, strip 87 is folded along the lines of weakening 89 to form folds 88. When chute 10 is in the position illustrated in FIG. 1, a line of weakening preferably is positioned a distance, indicated by arrows C, from the back lip of edge 100 of mouth 13 of chute 10. This distance C is about one-quarter to three-eighths of an inch. The lower lip 100 of back panel 12 of chute 10 extends a distance, indicated by arrows D, beyond the lower lip or edge 101 of the front panel 11 of chute 10.

Each paddle wheel 15, 16 is of equal shape and dimension and includes a plurality of equally spaced outwardly extending paddles or arms 17 attached to the cylindrical periphery 18 of the paddle wheel. Each arm 17 extends outwardly a distance, indicated by arrows F, from periphery 18. Paddle wheels 15 are attached to and rotate simultaneously with driven axle 20. Paddle wheels 16 are fixedly attached to and rotate simultaneously with driven axle 21. Belts 23 move in the direction of arrow G over conveyor table 22. The shortest horizontal distance between the longitudinal centerlines of axles 20 and 21 is indicated by arrows H. Axles 20 and 21 and paddle wheels 15 and 16 rotate in the directions indicated by arrow I and J. On paddle wheels 15, the outer tips of each paddle 17 lie on an imaginary circle which is outside and concentric with peripheral surface 18. The distance of the longitudinal centerline of axle 21 above belts 23 is indicated by arrows K. The vertical distance between the longitudinal centerlines of axles 20 and 21 is indicated by arrows L.

Shafts 32 and 33 are fixedly attached to chute 10 and are journalled for rotation in a frame (not shown). The ends of axles 20 and 21 are also journalled for rotation in the same frame, and conveyor table 22 is typically carried on the same frame. Motive power means for oscillating chute 10, for rotating axles 20 and 21, and for moving belts 23 are well known in the art and will not be discussed in detail herein.

Axle 20 presently rotates at a speed which is greater than the speed at which axle 21 rotates. The outer ends or tips of arms 17 on paddle wheels 15 contact and impart downward and forward forces to paper strip 87 dispensed by chute 10. Paddle wheels 16 and axle 21 catch the folds or crests 88 in the paper. The rotation of axle 21 and paddle wheels 16 is slightly retarded with respect to the speed of movement of belts 23 in the direction of arrow G, and arms 17 slightly temporarily impeded the progress of each fold 88, facilitating the creation of spaces between folds 88. The distance, indicated by arrows M, between adjacent pairs 88 of folds moving along table 22 is in the range of one quarter of an inch to three inches, preferably about one inch. A distance of about one inch facilitates the stacking of the refolded paper on a horizontal stacking platform or table. The stacking platform is slightly lower than the conveyor. Paper travels over the edge of the conveyor table 22 and downwardly onto the stacking table. As the amount of paper on the stacking platform increases, the platform gradually moves downwardly from the table 22. Once the stack of paper on the platform is the desired height, the stack of paper is removed from the stacking platform.

The folded paper strip shown on conveyor 23 in FIGS. 1 and 2 includes a first lower group of parallel co-planar folds 88 which contact the belts 23 of conveyor table 22 and includes a second upper group of parallel co-planar folds 88. The second group of folds 88 is spaced apart from conveyor belts 23 and from the first group of folds 88.

Figure 3:
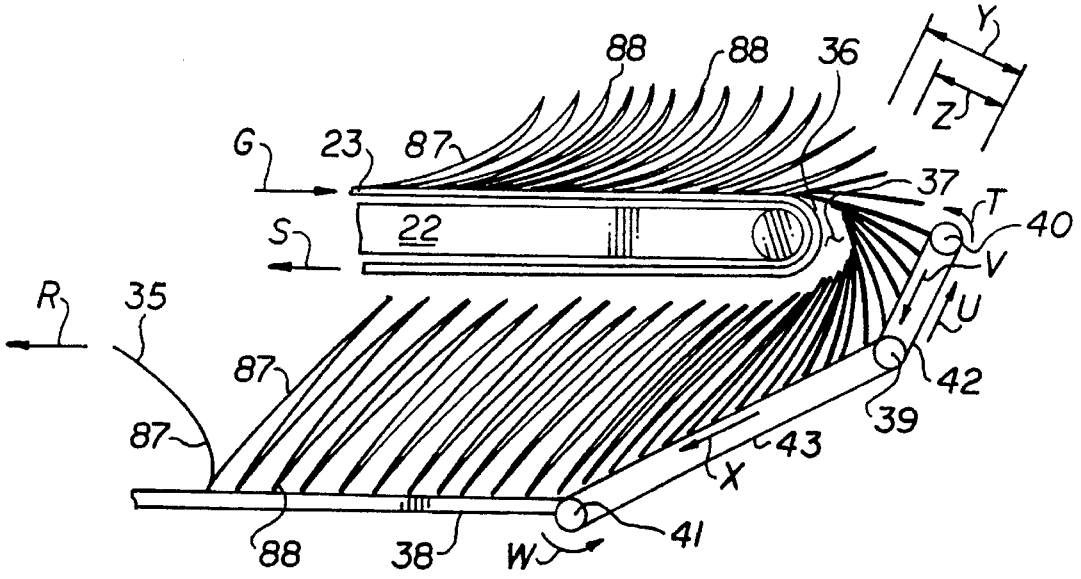
FIG. 3 is a side view illustrating apparatus constructed in accordance with the principles of the invention to alter the orientation of the stack of folded paper produced by the apparatus of FIGS. 1 and 2.

FIG. 3 illustrates the inverting apparatus used to process the stack of folded paper which is produced by the refolder of FIGS. 1 and 2 and which is transported by continuous conveyor belts 23 in the direction of arrow G. In FIG. 3, when the stack of folded paper reaches the end 36 of the conveyor table 22, it begins to fall toward continuous belt (or belts) 42 carried by rollers 39 and 40. Rollers 39 and 40 turn counterclockwise in FIG. 3 in the direction indicated by arrow T. Roller 41 also turns counterclockwise in the direction of arrow W in FIG. 3. In FIG. 3, roller 40 is illustrated at a position slightly beneath conveyor 23. It is sometimes preferable to fix the position of roller 40 at a higher elevation about level with belt 23 so that the stack of folded paper will not travel out over and above roller 40. While a pair of belts 42, 43 each having a different slope is shown in FIG. 3, three or more belts may be utilized, or a single belt having a selected slope may be utilized.

Figure 4:
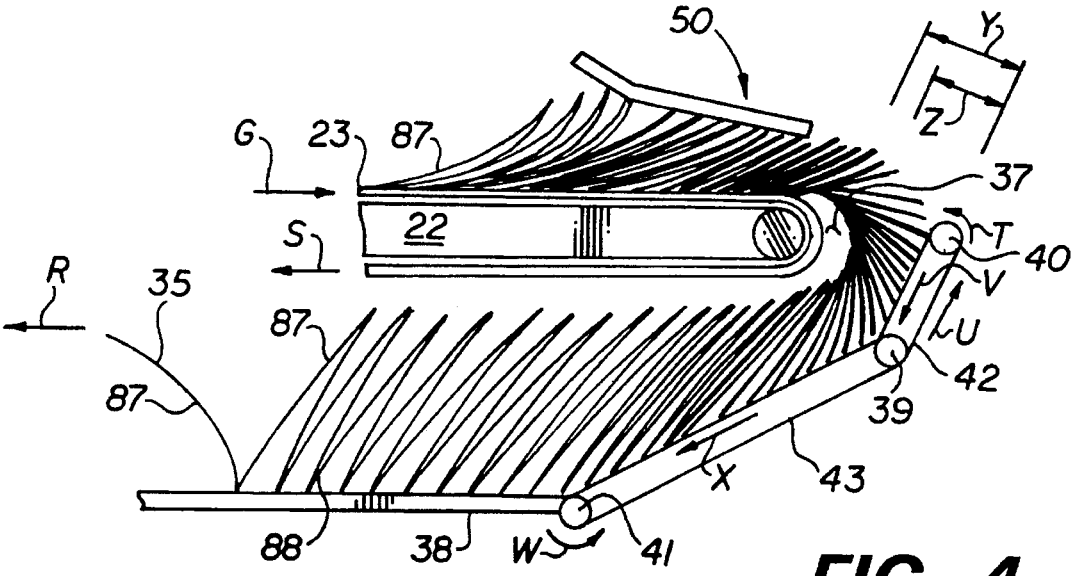
FIG. 4 is a side view illustrating an alternate embodiment of apparatus constructed in accordance with the invention.

Belt 42 presently includes a plurality of parallel spaced apart feet 59 which extend outwardly from the belt in a direction away from rollers 39 and 40. Continuous belt 43 (or belts) also includes a plurality of comparable parallel spaced apart feet which extend outwardly from belt 43 in a direction away from rollers 39 and 41. Belts 42 and 43 travel at a faster speed than belt 23 and function to move past and riffle the second group of folds 88 passing adjacent belts 42 and 43. When belt 42 riffles the folds 88 adjacent belt 42, it urges or displaces the folds in the direction of arrow V. The portion of belt 42 traveling from roller 39 to roller 40 travels in the direction indicated by arrow U. When belt 43 riffles the folds 88 adjacent belt 42, it urges or displaces the folds in the direction of arrow X. By way of example, and not limitation, belts 42 and 43 may move at about fifty feet a minute when belt 23 moves at about one foot a minute. The greater speed of belt 42 also facilitate altering the direction of travel of the folded paper strip down and around the end 36 of table 22. In order to turn the paper strip down and around the end 36 of table 22, the folds adjacent belt 42 must move faster than the folds 88 adjacent the end 36. When the folds in strip 87 are closely packed, a space 37 can be formed between the end 36 and the folds 88 closest to end 36. In FIG. 4, the width of space 37 equals the distance from end 36 to belt 42, indicated by arrows Y, minus the distance from the folds 88 nearest end 36 to belt 42, indicated by arrows Z. While the invention can be operated when such a space 37 is generated, it is preferable that space 37 not be generated and that the folds 88 closest to table 22 travel immediately next to end 36 when the stack of paper travels down around end 36. In practice, the distance indicated by arrows Y is preferably about equal to the greatest distance of the outermost folds 88 above belt 32 after folds 88 have passed through shield 50, i.e., the distance indicated by arrows Y equals the compacted height of the paper stack being transported by belt 23.

For the sake of clarity, in FIGS. 3 and 4, the folds 88 spaced apart from and above belt 23 are shown spaced apart, as they often are when the strip 87 is passing through a refolder. In the practice of the invention, however, it is preferred that the folds in strip 87 be tightly packed such that each fold length of paper is pressed against and contacts the fold lengths which immediately precede and follow that fold length of paper, and, accordingly, it is preferred that each fold 88 spaced apart from and above belt 23 be immediately adjacent the folds 88 immediately preceding and following that fold 88. Obtaining such a tightly packed stack of paper on conveyor belt 23 is sometimes more readily obtained on a spiral or belt paper folder than on the refolder shown in FIGS. 1 and 2 herein. When the stack of paper on belt 23 is tightly packed, the stack behaves more like a solid piece of rubber or elastic material, is better controlled, and more readily travels downwardly around end 36 without causing a gap, "break away", or slight spacing to form along the folded strip 87. When a gap or break away forms, one of the folds 88 tends to be pulled down (or up) from its normal spacing away from belt 23, causing the fold 88 to bend or lip over.

Figure 5:
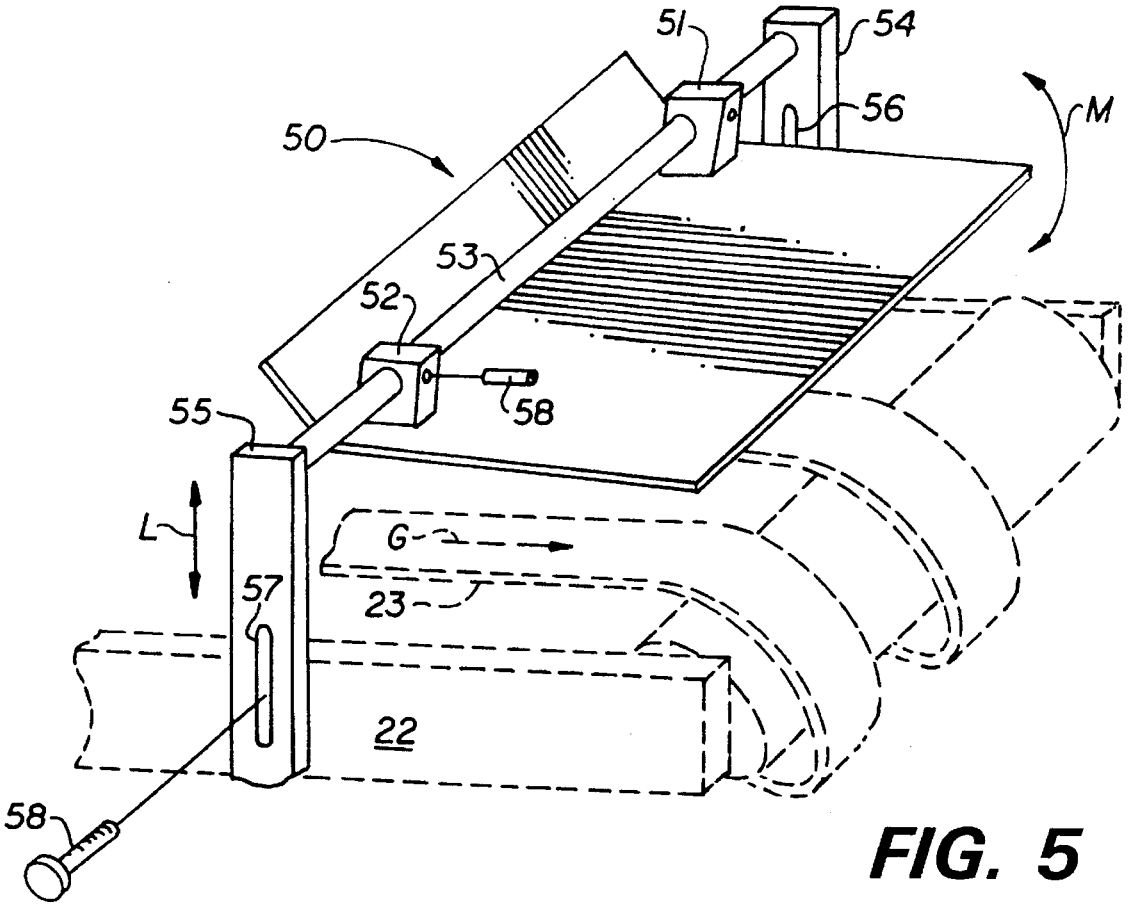
FIG. 5 is a perspective view further illustrating the apparatus of FIG. 4; and, FIG. 6 is a side elevation view of a conveyor belt utilized in the practice of the invention.
Figure 6:
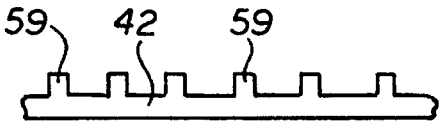

In order to facilitate the travel of the stack of folded paper downwardly around end 36, it is presently preferred that the folded paper traveling along belt 23 be compressed toward belt 23 using the guide shield 50 illustrated in FIGS. 4 and 5. As depicted in FIG. 4, shield 50 is canted toward belt 23 and deflects the folded paper toward belt 23 into an orientation which is closer to being parallel to belt 23 and table 22. When the folded zig-zag paper strip comprising the stack of paper carried by belt 23 is compressed by guide shield 50, the paper stack reliably maintains its continuity as it travels along belt 23 and gaps are much less likely to form in the stack when in travels around end 36.

In FIG. 5, guide shield 50 is fixed to blocks 51 and 52. Blocks 51 and 52 (and shield 50) can be pivoted about elongate cylindrical rod 53 in the directions indicated by arrows M. When shield 50 is in the desired position, set screw (s) 58 are tightened through blocks 51, 52 and against rod 53 to fix the blocks in position with respect to rod 53. The ends of rod 53 are each fixedly secured in one of arms 54, 55. A slot 56, 57 is formed through each arm 54 and 55, respectively, to permit the height of shield 50 to be vertically adjusted in the directions indicated by arrows L. A screw(s) is tightened through each slot 56, 57 into table 22 to secure the arms 54 and 55 in fixed position.

The inverted paper stack on belt 43 travels onto a rectangular, horizontal shelf 38. The end 35 of the inverted paper stack can be directed through another paper processing machine .in the direction of arrow R, or the inverted stack can be otherwise transported or stored. In order to prevent the paper strip 87 on shelf 38 from sliding or falling over onto itself and flattening out, a slow moving conveyor belt can be placed around shelf 38 such that the folds 88 from belt 43 come to rest on and are gradually carried away from belt 43 in the direction of arrow S. In FIG. 3, arrow S also indicates the direction of travel of belt 23 when it travels along the bottom of table 22.

Having described my invention in such terms as to enable those skilled in the art to practice and understand it, and having described the presently preferred embodiments thereof, I claim:

1. Apparatus for producing continuous form stationery by folding a strip of paper along transverse lines of weakening formed therein, said apparatus including (a) a frame, (b) guide means mounted on said frame for alternately distributing said successive lines of weakening in said paper in substantially opposite directions, (c) folding means carried on said frame and operatively associated with said guide means for urging said paper distributed by said guide means into a zig-zag folded condition, (d) a generally horizontally oriented conveyor assembly for receiving folded paper from said folding means, forming a stack of the folded paper, and carrying said stack of folded paper away from said folding means in a first direction of travel, said stack including (i) first and second groups of folded edges, said first group of folded edges contacting said conveyor assembly, said second group of folded edges being generally spaced apart from and extending above said first group of folded edges and said conveyor assembly, and (ii) a plurality of sheets each bounded by a parallel pair of said folded edges and canted in said first direction of travel, alternating ones of said sheets each being connected to and overlaying the one of said first group of said folded edges connected to the immediately preceding one of said sheets, and laying on and contacting a portion of said immediately preceding one of said sheets extending from said one of said first group of folded edges such that said portion of said immediately preceding one of said sheets is pressed against said conveyor assembly;

(e) inverting means for turning over said stack of folded paper, said inverting means comprising conveyor means for receiving said stack of folded paper from said conveyor assembly and incrementally bending said sheets downwardly around to move said stack in a second direction of travel rearwardly from said first direction of travel onto a support surface such that after said stack of folded paper is inverted onto said support surface, (i) said first group of folded edges are spaced above said second group of folded edges, and (ii) said sheets in said stack of folded paper, are (A) in a substantially upright orientation, and (B) are prevented from canting in said rearward direction of travel and prevented from overlaying adjacent sheets such that portions of alternating ones of said sheets extending from said second group of folded edges are not canted in said rearward direction of travel, and pressed against said support surface, the upright orientation of said sheets facilitating feeding said sheets into another paper processing machine, said conveyor contacting said second group of folded edges and urging said second group of folded edges downwardly and in said second direction of travel.

2. Apparatus for producing continuous form stationery by folding a strip of paper along transverse lines of weakening formed therein, said apparatus including (a) a frame, (b) guide means mounted on said frame for alternately distributing said successive lines of weakening in said paper in substantially opposite directions, (c) folding means carried on said frame and operatively associated with said guide means for urging said paper distributed by said guide means into a zig-zag folded condition, (d) a generally horizontally oriented conveyor assembly for receiving folded paper from said folding means, forming a stack of the folded paper, and carrying said stack of folded paper away from said folding means in a first direction of travel, said stack including (i) first and second groups of folded edges, said first group of folded edges contacting said conveyor assembly, said second group of folded edges being generally spaced apart from and extending above said first group of folded edges and said conveyor assembly, and (ii) a plurality of upstanding sheets each bounded by a parallel pair of said folded edges and canted in said first direction of travel, alternating ones of said sheets each being connected to and overlaying the one of said first group of said folded edges connected to the immediately preceding one of said sheets, and laying on and contacting a portion of said immediately preceding one of said sheets extending from said one of said first group of said folded edges such that said portion of said immediately preceding one of said sheets is pressed against said conveyor assembly;

(e) inverting means for turning over said stack of folded paper, said inverting means comprising (i) means for compacting said stack of folded paper to displace said second group of folded edges closer to said conveyor assembly such that said sheets are more nearly parallel to said conveyor assembly, increase the cant of said sheets in said first direction of travel, and form a compressed stack of folded paper; and, (ii) conveyor means for receiving said compressed stack of folded paper and incrementally displacing said sheets downwardly around to move said stack in a second direction of travel rearwardly from said first direction of travel onto a support surface such that after said stack of folded paper is inverted onto said support surface, said first group of folded edges are spaced above said second group of folded edges.

3. Apparatus for producing continuous form stationery by folding a strip of paper along transverse lines of weakening formed therein, said apparatus including (a) a frame, (b) guide means mounted on said frame for alternately distributing said successive lines of weakening in said paper in substantially opposite directions, (c) folding means carried on said frame and operatively associated with said guide means for urging said paper distributed by said guide means into a zig-zag folded condition, (d) a generally horizontally oriented conveyor assembly for receiving folded paper from said folding means, forming a stack of the folded paper, and carrying said stack of folded paper away from said folding means in a first direction of travel, said stack including (i) first and second groups of folded edges, said first group of folded edges contacting said conveyor assembly, said second group of folded edges being generally spaced apart from and extending above said first group of folded edges and said conveyor assembly, and (ii) a plurality of upstanding sheets each bounded by a parallel pair of said folded edges and canted in said first direction of travel, alternating ones of said sheets each being connected to and overlaying the one of said first group of said folded edges connected to the immediately preceding one of said sheets, and laying on and contacting a portion of said immediately preceding one of said sheets extending from said one of said first group of said folded edges such that said portion of said immediately preceding one of said sheets is pressed against said conveyor assembly;

(e) inverting means for turning over said stack of folded paper, said inverting means comprising (i) means for receiving said stack of folded paper from said conveyor assembly and incrementally displacing said sheets downwardly around to move said stack in a second direction of travel rearwardly from said first direction of travel onto a support surface such that after said stack of folded paper is inverted onto said support surface, said first group of folded edges are spaced above said second group of folded edges, and said sheets in said stack of folded paper are in a substantially upright orientation facilitating feeding said sheets into another paper processing machine; and, (ii) means for contacting, moving, and guiding said second group of folded edges downwardly in said second direction of travel and to facilitate the displacement of said sheets downwardly in said second direction of travel rearwardly from said first direction of travel onto said support surface in said substantially upright orientation.

* * * * *